US005974844A

United States Patent [19]

Harrelson et al.

[11] Patent Number: 5,974,844

[45] Date of Patent: Nov. 2, 1999

[54] COMBINATION KEY AND TRANSPONDER CARRIER

[75] Inventors: Donald Harrelson, Tarboro; Douglas Davis, Rocky Mount, both of N.C.

[73] Assignee: Ilco Unican Corp., Rocky Mount, N.C.

[21] Appl. No.: 09/072,090

[22] Filed: May 4, 1998

[51] Int. Cl.[6] ..... E05B 19/04

[52] U.S. Cl. ..... 70/408; 70/278

[58] Field of Search ..... 70/408, 413, 278

[56] References Cited

U.S. PATENT DOCUMENTS

| | | | |
|---|---|---|---|
| 4,287,735 | 9/1981 | Brunken et al. | 70/408 X |
| 4,516,000 | 5/1985 | Ryberg et al. | 70/408 X |
| 5,433,096 | 7/1995 | Janssen et al. | 70/278 |
| 5,632,168 | 5/1997 | Yano | 70/408 |
| 5,727,408 | 3/1998 | Mizuno et al. | 70/413 |

FOREIGN PATENT DOCUMENTS

| | | | |
|---|---|---|---|
| 2448607 | 10/1980 | France | 70/408 |
| 4141270 | 6/1993 | Germany | 70/408 |
| 404080482 | 3/1992 | Japan | 70/408 |
| WO 95/32348 | 5/1995 | WIPO . | |
| WO 95/33115 | 5/1995 | WIPO . | |

*Primary Examiner*—Suzanne Dino Barrett
*Attorney, Agent, or Firm*—Hill & Simpson

[57] ABSTRACT

An improved combination key and transporter assembly is provided whereby the head of the key includes an elongated slot that passes through the head. A carrier is molded into the slot disposed in the key head which includes a hollow interior bound by a plurality of tabs for frictionally retaining a transponder in the carrier. After the transponder is inserted into the carrier, the key head, carrier and transponder are inserted into a mold and an outer sheath is molded around the head, carrier and transponder. The resulting assembly has a slim profile and may be mounted onto a standard sized key chain or key holder. The assembly may be manufactured using an automated process without hand sub-assembly steps.

13 Claims, 1 Drawing Sheet

COMBINATION KEY AND TRANSPONDER CARRIER

FIELD OF THE INVENTION

The present invention relates generally to keys used in combination electronic and mechanical lock systems. More specifically, the present invention relates to an improved design for a key which is equipped with a transponder. Still more specifically, the present invention relates to an improved structure for attaching a transponder to a key and an improved method of manufacturing a combination key and transponder assembly.

BACKGROUND OF THE INVENTION

It is known to equip keys used for rotating the tumblers of mechanical locks with electronic devices such as small lights or transponders for sending signals to electronic anti-theft devices or electronic lock mechanisms. Typically, the transponders are encased in a plastic housing which is mounted to the head of the key. However, two additional assembly steps are required. Specifically, the transponder must be assembled to the housing and the housing then must be attached or otherwise assembled to the key head. Further, currently-available housings that attach a transponder to a key head are large and bulky and are not amenable to attachment to a standard key chain.

Therefore, there is a need for an improved combination key and transponder whereby the transponder is attached to the key in an efficient manner using automated equipment and whereby the size of the key head, transponder and housing or casing is relatively small so that the combination easily fits on a standard key ring. Further, there is a need for an improved combination key and transponder which can be manufactured using automated equipment and which will not require any sub-assembly steps to be carried out manually.

SUMMARY OF THE INVENTION

The present invention satisfies the aforenoted need by providing a combination key and transponder assembly which comprises a key blank comprising a head. The head further comprises a slot. The slot accommodates a carrier which, in turn, comprises an outer periphery that is matably received in the slot and a hollow interior for accommodating a transponder. The head, slot and carrier body are encapsulated under a molded sheath. As a result, a combination key and transponder are provided whereby the head of the key, which includes the transponder and an encapsulating sheath, is relatively thin thereby enabling it to be easily accommodated on a standard key ring.

In an embodiment, the slot in the key head passes entirely through the head.

In an embodiment, the slot of the key head passes through the key head and, further, the hollow interior of the carrier passes through the carrier.

In an embodiment, the carrier comprises at least one tab for frictionally engaging the transponder and maintaining the position of the transponder in the carrier.

In an embodiment, the carrier comprises a central body disposed between two opposing outer flanges. The central body is disposed in the slot and the outer flanges are disposed on opposing sides of the key head. The hollow interior of the carrier provides communication through the key head thereby enabling the material from which the sheath is molded to penetrate the hollow interior of the carrier and pass through the carrier.

In an embodiment, the central body of the carrier comprises a plurality of inwardly extending tabs that frictionally engage the transponder. In a preferred embodiment, each side of the central body of the carrier comprises two pairs of tabs, each pair of tabs being disposed on opposing sides of the slot. Accordingly, each side of the carrier includes four inwardly protruding tabs for frictionally engaging the transponder and maintaining the position of the transponder inside the central body of the carrier.

In an embodiment, the outer flanges of the carrier include the inwardly protruding tabs for frictionally engaging the transponder and trapping the transponder inside the hollow interior of the carrier.

In an embodiment, each flange of the carrier extends around the slot in the key head and further, each flange includes at least one tab disposed on opposing sides of the slot for frictionally retaining the transponder in the hollow interior of the carrier and between the two opposing flanges of the carrier.

In an embodiment, the key comprises a blade connected to the head and the slot is elongated and disposed in alignment with the blade.

In an embodiment, the present invention also provides a method of manufacturing a combination key and transponder assembly. The method comprises the steps of providing a key comprising a head with a slot disposed therein, molding a carrier in the slot, the carrier comprising a central body for accommodating a transponder, inserting the transponder into the central body of the molded carrier, molding a sheath around the head, slot, carrier and transponder.

In an embodiment, the slot extends through the head of the key and the central body of the carrier comprises a hollow interior that provides communication through the head and the step of molding the sheath further comprises extending a portion of the sheath through the hollow interior and around the transponder to securely fix the transponder in place.

In an embodiment, the method further comprises molding a carrier which, in turn, further comprises a plurality of tabs for frictionally engaging the transponder and holding the transponder in place during the step of molding the sheath.

In an embodiment, the step of molding a carrier further comprises molding a carrier having two flanges disposed on opposing sides of a central body. Each flange includes at least one deformable tab for frictionally retaining the transponder in the hollow interior during the step of molding the sheath.

In an embodiment, the flanges of the carrier extend around the slot and each flange comprises at least two tabs, each tab being disposed on opposing sides of the slot.

In an embodiment, each flange of the molded carrier comprises two spaced-apart tabs on opposing sides of the slot.

Other advantages and objects of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiment illustrated in greater detail in the accompanying drawing and described below by way of an example of the present invention.

In the drawing.

Figures 1, 2, 3, 4:
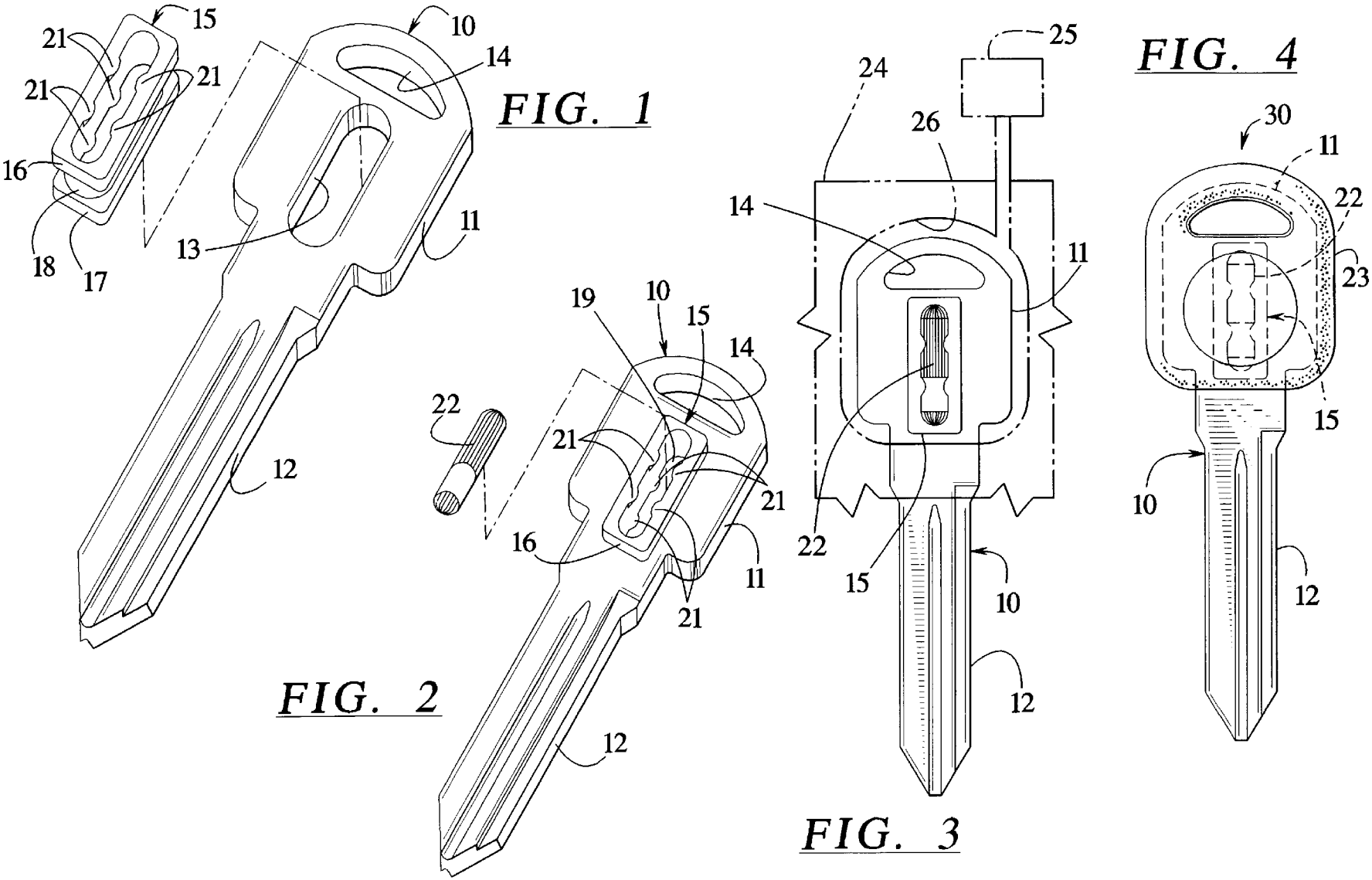
FIG. 1 is a perspective view of a key blank and carrier made in accordance with the present invention.
FIG. 2 is a perspective view of the key blank and carrier shown in FIG. 1 with the carrier inserted into a slot disposed in the key blank and further illustrating a transponder.
FIG. 3 is a schematic plan view of the key blank, carrier and transponder inserted into a mold for molding an outer sheath.
FIG. 4 is a plan view of the key blank, carrier, transponder and outer sheath of the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Turning first to FIG. 1, a key blank 10 is illustrated which includes a head 11 that is connected to a blade 12. The head 11 includes an elongated slot 13 which, in the preferred embodiment illustrated in FIG. 1, is disposed in a general alignment with the blade 12. The head also includes an opening 14 for mounting the blank 10 onto a key chain.

FIG. 1 also illustrates a transponder carrier 15. The carrier 15 is accommodated in the slot 13. In a preferred embodiment, the carrier 15 is permanently molded into the slot 13. Further, the carrier 15 is also configured to include outer flanges 16 and 17 with a central body 18 disposed therebetween. The central body 18 includes a hollow interior 19.

At opposing sides of the central body 18 or the opposing flanges 16, 17, a plurality of tabs shown at 21 are provided. The tabs 21 frictionally engage the transponder 22 (see FIG. 2) and trap the transponder 22 inside the hollow interior 19 of the carrier 15. Each flange 16, 17 or each opposing side of the central body 18 may include one or more tabs 21. It is preferable that at least one tab 21 be included at each flange 16, 17 or opposing side of the central body 18 for trapping the transponder 22 in the hollow interior 19.

Turning to FIG. 2, after the carrier 15 is molded into the slot 13 or forced into the slot 13, the transponder 22 is inserted into the hollow interior 19, past the tabs 21.

After the transponder 22 is inserted into the carrier 15, an outer sheath 23 is molded over the entire head 11, carrier 15 and transponder 22 (see FIG. 4). Referring to FIG. 3, the sheath 23 is molded using an injectable mold 24 by placing the key 10 with carrier 15 and transponder 22 disposed therein into the mold 24 and injecting liquid plastic material from a reservoir 25 into the cavity shown at 26. Because the slot 13 extends through the head 11 and further because the carrier 15 includes the hollow interior 19 which passes through the carrier 15, molten plastic can be communicated through the carrier 15 and around the transponder 22 to secure the transponder 22 in place and provide a sturdy structure. As a result, a key 10 can be equipped with a transponder 22 and encasing sheath 23 without utilizing a bulky casing or housing for the transponder 22. The key 10 with sheath 23 as shown in FIG. 4 may be easily attached to a standard key chain or key ring. Thus, the employment of a slot 13 that extends through the head 11 of the key 10 and further which accommodates the transponder 22 therein saves space without adversely affecting the structural integrity of the key 10.

Accordingly, to fabricate the key and transponder assembly 30 shown in FIG. 4, a key 10 is provided with a pre-punched slot 13 disposed in the head 11 of the key 10. A carrier 15 is then molded into the slot 13 or forced into the slot 13 if the carrier 15 is provided in a pre-molded state. Because of the advantages of having the outer flanges 16, 17, the preferred method of fabricating the assembly 30 includes a step of molding the carrier 15 into the slot 13. After the carrier 15 is in place, the transponder 22 is forced past the tabs 21 and into the hollow interior 19 of the carrier 15. Then, the key 10, carrier 15 and transponder 22 are placed into a mold 24 which includes a cavity 26 for forming the outer sheath 23. Liquid plastic is then injected into the cavity 26 thereby forming the sheath 23 thereby producing the assembly 30 as shown in FIG. 4.

From the above description, it is apparent that the advantages and objects of the present invention have been achieved. While only certain embodiments have been set forth, alternative embodiments and various modifications will be apparent from the above description to those skilled in the art.

What is claimed is:

1. A combination key and transponder assembly comprising:

a key blank having a key head with a top and a bottom surface, the head having a first aperture formed therein, the assembly further comprising a molded plastic material transponder carrier adapted to be received in the first aperture having portions projecting above at least one of the surfaces of said key head, said portions having peripheral areas overlying said at least one surface of the key head, said carrier having a second aperture therethrough dimensioned to receive a transponder, the second aperture being open to at least the one surface of the key head when the carrier is disposed in the first aperture, the second aperture having two opposing sidewalls, the opposing sidewalls having raised protuberances locally reducing a width of the second aperture, the transponder being dimensioned to fit within the second aperture, the transponder also having a width dimensioned at least as great as the width of the second aperture whereby, upon insertion of the transponder into the second aperture, the transponder will be held in the second aperture by said protuberances, the assembly further comprising a molded key head sheath molded around portions of said key head covering said carrier and fixing the carrier in the key head and extending into said second aperture and fixing said transponder in said second aperture.

2. The assembly of claim 1 wherein the first aperture passes through the key head.

3. The assembly of claim 1 wherein the first aperture passes through the key head and the second aperture of the carrier passes through the carrier.

4. The assembly of claim 1 wherein the first aperture passes through the key head and the carrier comprises a central body disposed between two opposing outer flanges, the central body being disposed in the first aperture and the outer flanges being disposed on the opposing top and bottom surfaces of the key head, the central body defining a hollow interior that provides fluid communication through the head.

5. The assembly of claim 4 wherein each flange comprises at least one inwardly protruding tab for frictionally engaging the transponder.

6. The assembly of claim 4 wherein each flange of the carrier extends around the slot in the head, each flange further comprises two tabs disposed on opposing sides of the slot for frictional retaining the transponder in the hollow interior of the carrier and between the two flanges.

7. The assembly of claim 1 wherein the key comprises a blade connected to the head, the first aperture being elongated and disposed in alignment with the blade, the first aperture passing through the head, the carrier comprising a central body that is matably received in the first aperture and disposed between two flanges, the flanges being disposed on the opposing top and bottom surfaces of the head with the head and central body sandwiched between the flanges, the central body of the carrier defining a hollow interior, the first and second flanges each comprising a plurality of deformable and inwardly protruding tabs for capturing the transponder between the tabs and in the hollow interior of the carrier.

8. The assembly of claim 7 wherein the first aperture passes through the key head, the hollow interior of the carrier provides communication through the carrier and through the key head and the molded sheath extends through the hollow interior and past the transponder.

9. The assembly of claim 7 wherein the molded sheath extends through the hollow interior and past the transponder.

10. A combination key and transponder assembly comprising:

a key comprising a head and a blade, the head comprising an elongated slot that extends through the head, the slot being aligned with the blade, the slot receiving a carrier comprising a hollow central body disposed between two opposing flanges, the central body being disposed in the slot and the flanges being disposed on opposing sides of the head, the central body providing communication through the head, each flange extending around the slot, each flange comprising at least two inwardly protruding and resilient tabs disposed on opposing sides of the slot, the central body of the carrier receiving a transponder, the transponder being trapped in the central body by frictional engagement between the transponder and the inwardly protruding tabs of the flanges, the head, slot, carrier and transponder being encapsulated by a molded sheath that extends through the central body of the carrier.

11. A method of manufacturing a combination key and transponder assembly, the method comprising the following steps:

providing a key comprising a head having two opposing sides with a slot disposed therein that extends through the head and between the opposing sides;

molding a carrier in the slot, the carrier comprising a central body having a hollow interior for receiving a transponder, the hollow interior providing communication through the central body, the carrier further comprising two opposing flanges disposed on opposing sides of the head, the flanges extending around the slot and each flange comprising two tabs disposed on opposing sides of the slot;

inserting the transponder into the central body of the carrier after the carrier is molded into the slot;

molding a sheath around the head, slot, carrier and transponder and at least partially through the hollow interior and around the transponder.

12. The method of claim 11 wherein the tabs are deformable for frictionally retaining the transponder in the hollow interior during the step of molding the sheath.

13. The method of claim 11 wherein each tab comprises two pairs of spaced-apart tabs, each pair of spaced-apart tabs being disposed on opposing sides of the slot.

* * * * *